US009309032B2

(12) United States Patent
Berge et al.

(10) Patent No.: US 9,309,032 B2
(45) Date of Patent: Apr. 12, 2016

(54) DISPENSER AND CLOSURE WITH HINGE ATTACHED TAMPER BAND

(71) Applicant: Silgan White Cap LLC, Downers Grove, IL (US)

(72) Inventors: Gary Berge, Crystal Lake, IL (US); Darren Neputy, Palos Hills, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 162 days.

(21) Appl. No.: 14/182,130

(22) Filed: Feb. 17, 2014

(65) Prior Publication Data

US 2015/0232237 A1 Aug. 20, 2015

(51) Int. Cl.

| | |
|---|---|
| ***B65D 35/44*** | (2006.01) |
| ***B65D 47/12*** | (2006.01) |
| ***B65D 41/34*** | (2006.01) |

(52) U.S. Cl.

CPC ..... *B65D 47/122* (2013.01); *B65D 41/3438* (2013.01)

(58) Field of Classification Search

CPC .... B65D 2101/00; B65D 33/34; B65D 35/44; B65D 41/32; B65D 41/34; B65D 41/3409; B65D 41/3423; B65D 41/3428; B65D 41/3442; B65D 41/3447; B65D 47/06; B65D 2101/0023; B65D 2101/0046

USPC ..... 215/252, 253; 220/265, 266, 276; 222/153.05, 153.06

See application file for complete search history.

(56) References Cited

U.S. PATENT DOCUMENTS

| | | | | |
|---|---|---|---|---|
| 2,148,864 | A | 2/1939 | Kistner | |
| 3,463,341 | A | 8/1969 | Fileds | |
| 4,305,516 | A * | 12/1981 | Perne | B65D 41/3442 215/252 |
| D272,324 | S | 1/1984 | Mumford et al. | |
| D273,368 | S | 4/1984 | Hayes | |
| 4,503,986 | A | 3/1985 | Nixdorff et al. | |
| 4,505,401 | A | 3/1985 | Berglund | |
| D278,311 | S | 4/1985 | Brown et al. | |
| 4,573,601 | A | 3/1986 | Berglund | |
| 4,653,657 | A | 3/1987 | Papavasilopoulos | |
| 4,805,791 | A | 2/1989 | Begley | |
| 4,852,751 | A | 8/1989 | Halfacre | |

(Continued)

FOREIGN PATENT DOCUMENTS

| | | | |
|---|---|---|---|
| DE | 296 09 596 U1 * | 10/1996 | |
| JP | 10-181758 A | 7/1998 | |

(Continued)

OTHER PUBLICATIONS

International Search Report and Written Opinion for PCT/US2015/015241 dated May 21, 2015, 8 pages.*

(Continued)

*Primary Examiner* — Patrick M Buechner

(74) *Attorney, Agent, or Firm* — Reinhart Boerner Van Deuren s.c.

(57) ABSTRACT

A closure for a container includes a tamper band that remains attached to the closure after the container is opened and the closure is removed. The tamper band includes a shaped internal surface and gaps to interact with a dispenser assembly for the container. The dispenser assembly includes tabs to interact with the tamper band of the closure and an alignment rim to engage with the internal surface of the tamper band.

21 Claims, 9 Drawing Sheets

(56) References Cited

U.S. PATENT DOCUMENTS

| | | | | |
|---|---|---|---|---|
| 5,040,692 | A * | 8/1991 | Julian | B65D 41/3409 215/252 |
| 5,295,600 | A * | 3/1994 | Kowal | B65D 41/3428 215/252 |
| D359,683 | S | 6/1995 | Beach et al. | |
| D361,265 | S | 8/1995 | Doxey | |
| 5,823,383 | A | 10/1998 | Hins | |
| 5,853,095 | A * | 12/1998 | Marshall | B65D 41/3428 215/252 |
| 5,927,549 | A | 7/1999 | Wood | |
| D445,678 | S | 7/2001 | Malmborg | |
| 6,330,959 | B1 | 12/2001 | Dark | |
| D454,066 | S | 3/2002 | Trabal | |
| D460,357 | S | 7/2002 | Kras et al. | |
| D467,501 | S | 12/2002 | Tacchella | |
| 6,557,714 | B2 | 5/2003 | Babcock et al. | |
| D476,565 | S | 7/2003 | Rosén | |
| 6,612,466 | B1 | 9/2003 | Malin | |
| D489,978 | S | 5/2004 | Brown | |
| 6,783,014 | B2 | 8/2004 | Luker | |
| 6,811,047 | B1 | 11/2004 | Hicks et al. | |
| 6,860,406 | B2 | 3/2005 | Kobetsky et al. | |
| 6,958,033 | B1 | 10/2005 | Malin | |
| D542,654 | S | 5/2007 | Szczesniak | |
| D542,655 | S | 5/2007 | Szczesniak | |
| D542,656 | S | 5/2007 | Szczesniak | |
| D544,348 | S | 6/2007 | Szczesniak | |
| D547,657 | S | 7/2007 | Tacchella | |
| D551,975 | S | 10/2007 | Gomoll et al. | |
| D552,483 | S | 10/2007 | Rigardo | |
| D564,884 | S | 3/2008 | Rittman | |
| D574,241 | S | 8/2008 | Braukmann et al. | |
| D579,332 | S | 10/2008 | Krivoshein | |
| 7,677,422 | B2 | 3/2010 | Lee | |
| 7,735,666 | B2 | 6/2010 | Niwa et al. | |
| 7,753,233 | B2 | 7/2010 | Umenaka | |
| D631,349 | S | 1/2011 | Arnell et al. | |
| 7,882,977 | B2 | 2/2011 | Johnson | |
| D633,386 | S | 3/2011 | Taber et al. | |
| D634,199 | S | 3/2011 | Taber et al. | |
| D634,200 | S | 3/2011 | Taber et al. | |
| D646,263 | S | 10/2011 | Yuan et al. | |
| 8,105,226 | B2 | 1/2012 | Wada | |
| D661,185 | S | 6/2012 | Battat | |
| 8,231,020 | B2 | 7/2012 | Taber et al. | |
| 8,231,025 | B2 | 7/2012 | Johnson | |
| D671,187 | S | 11/2012 | Saringer | |
| D672,238 | S | 12/2012 | Aziz et al. | |
| D672,241 | S | 12/2012 | Sawicki et al. | |
| D679,597 | S | 4/2013 | Tamarindo | |
| D682,688 | S | 5/2013 | Murray | |
| 8,443,999 | B1 | 5/2013 | Reinders | |
| D684,055 | S | 6/2013 | Kwon | |
| D684,056 | S | 6/2013 | Kwon | |
| D684,057 | S | 6/2013 | Kwon | |
| D684,058 | S | 6/2013 | Kwon | |
| D686,495 | S | 7/2013 | Murray | |
| 8,528,757 | B2 | 9/2013 | Bisio | |
| D693,220 | S | 11/2013 | Luo | |
| 8,616,394 | B2 | 12/2013 | Kim | |
| D705,061 | S | 5/2014 | Jo et al. | |
| 8,807,361 | B2 | 8/2014 | Luo | |
| D712,266 | S | 9/2014 | Römer et al. | |
| D712,743 | S | 9/2014 | Neputy et al. | |
| D712,744 | S | 9/2014 | Neputy et al. | |
| 8,950,939 | B2 | 2/2015 | Last et al. | |
| 2004/0200797 | A1 * | 10/2004 | Hicks | B65D 41/0421 215/305 |
| 2004/0245286 | A1 | 12/2004 | Lee | |
| 2005/0011911 | A1 | 1/2005 | Vaughan | |
| 2005/0040181 | A1 | 2/2005 | Kurosawa et al. | |
| 2005/0139607 | A1 | 6/2005 | Kobetsky et al. | |
| 2005/0205438 | A1 | 9/2005 | Hierzer et al. | |
| 2008/0124432 | A1 | 5/2008 | Ma | |
| 2008/0135513 | A1 * | 6/2008 | Umenaka | B65D 75/5883 215/252 |
| 2009/0223963 | A1 | 9/2009 | Bisio | |
| 2010/0213213 | A1 | 8/2010 | Albers et al. | |
| 2011/0210122 | A1 | 9/2011 | Benoit-Gonin et al. | |
| 2012/0211460 | A1 | 8/2012 | Tamarindo | |
| 2012/0325769 | A1 | 12/2012 | Essebaggers et al. | |
| 2013/0270270 | A1 | 10/2013 | Reinders | |
| 2014/0010481 | A1 | 1/2014 | Last et al. | |
| 2014/0048536 | A1 | 2/2014 | Bisio | |
| 2014/0263475 | A1 | 9/2014 | Totten | |
| 2015/0129533 | A1 | 5/2015 | Taber et al. | |
| 2015/0232237 | A1 | 8/2015 | Berge | |

FOREIGN PATENT DOCUMENTS

| | | | |
|---|---|---|---|
| JP | 10-258850 | | 9/1998 |
| JP | 2002-104447 | A | 4/2002 |
| JP | 2011-246128 | A | 12/2011 |
| JP | 2014-019447 | | 2/2014 |
| KR | 2002-0024043 | | 3/2002 |
| WO | WO 2004/045977 | A1 | 6/2004 |
| WO | WO 2008/050361 | A1 | 5/2008 |

OTHER PUBLICATIONS

U.S. Appl. No. 29/482,293, filed Feb. 17, 2014, Berge et al.
U.S. Appl. No. 29/449,192, filed Mar. 14, 2013, Neputy et al.
U.S. Appl. No. 29/449,157, filed Mar. 14, 2013, Neputy et al.
U.S. Appl. No. 14/077,868, filed Nov. 12, 2013, Taber et al.
U.S. Appl. No. 29/472,406, filed Nov. 12, 2013, Taber et al.
International Search Report and Written Opinion for PCT/US2015/056238, mailed Dec. 30, 2015, 11 pages.
U.S. Appl. No. 29/507,935, filed Oct. 31, 2014, Gary Berge.
Silgan White Cap, Secure-Spout—9mm Spout with Fitment Brochure, believed to be publically available on Jun. 11, 2014 2014 and representative of closure and spout believed to be publically available on Jun. 11, 2014, 3 pages.
Flexible Packaging. Silgan White Cap to Introduce Secure-Spout Pouch Technology at Global Pouch Forum. Jun. 1, 2014 [online], [site visited Nov. 18, 2015]. Available from Internet, <URL:http://www.flexpackmag.com/keywords/4416-silgan-white-cap>.
Images of Spouts and Closures, document believed to be publicly available at least by Aug. 2012, 1 page.
Gualapack System, Image of Spouts and Caps, dated Apr. 1, 2013, at http://www.gualapack.com/img/pagine/prodotti/tappi/1.jpg, believed to be publicly available from Gualapack System at least by Aug. 2012, 1 page.
Gualapack System, Image of first stacked caps, dated Apr. 1, 2013, at http://www.gualapack.com/img/pagine/prodotti/innovazione/1.jpg, believed to be publicly available from Gualapack System at least by Aug. 2012, 1 page.
Gualapack System, Image of second stack caps, dated Apr. 1, 2013, at http://www.gualapack.com/img/pagine/prodotti/innovazione/2.jpg, believed to be publicly available from Gualapack System at least by Aug. 2012, 1 page.
Gualapack System, Image of third stacked caps, dated Apr. 1, 2013, at http://www.gualapack.com/img/pagine/prodotti/innovazione/3.jpg, believed to be publicly available from Gualapack System at least by Aug. 2012, 1 page.

* cited by examiner

DISPENSER AND CLOSURE WITH HINGE ATTACHED TAMPER BAND

BACKGROUND OF THE INVENTION

The present invention relates generally to the field of containers. The present invention relates specifically to a closure including a tamper band and dispenser for a container. Conventional containers may include a threaded neck or dispensing spout that engages with cooperating threads of a closure to seal the container. Closures may also include a tamper band that breaks or provides some other form of visual indication that the closure has been altered.

SUMMARY OF THE INVENTION

One embodiment of the invention relates to a closure for a container. The closure includes an inner wall having a first end and a second end, and an interior surface that defines a central axis. The closure further includes a thread on the interior surface of the inner wall. The closure further includes an end wall that encloses the first end of the inner wall. The closure further includes an outer sidewall having a first end and a second end, where the inner wall is located inside of and surrounded by the outer sidewall. The closure further includes a channel located between the inner wall and the outer sidewall that allows air to pass through the closure. The closure further includes a support structure coupling the inner wall to the outer sidewall. The closure further includes a tamper band extending downward away from the second end of the inner wall. The tamper band includes a radially outward facing surface and a radially inward facing surface. The tamper band further includes first and second frangible connectors coupling the tamper band to the second end of the inner wall. The tamper band further includes first and second hinge connectors coupling the tamper band to the second end of the inner wall. The tamper band further includes a first gap and a second gap extending between the radially outward facing surface and the radially inward facing surface, where the first hinge connector is located between the first and the second gaps in the counterclockwise direction. The tamper band further includes a rib extending radially inward from the radially inward facing surface and extending in the circumferential direction along the radially inward facing surface, where the rib includes an upper surface extending radially inward and away from an upper edge of the radially inward facing surface and a lower surface extending radially inward and away from a lower edge of the radially inward facing surface.

Another embodiment of the invention relates to a plastic closure for a container. The plastic closure includes a sidewall defining a longitudinal axis and having first end and a second end. The plastic closure further includes an end wall sealed to the first end of the sidewall. The plastic closure further includes a thread extending from an inner surface of the sidewall. The plastic closure further includes a tamper-indicating band positioned below the second end of the sidewall. The tamper-indicating band includes a first portion having a clockwise facing surface and a counterclockwise facing surface where the first portion extends at least 130 degrees around the second end of the sidewall. The tamper-indicating band further includes a second portion having a clockwise facing surface and a counterclockwise facing surface where the second portion extends around at least 130 degrees of the second end of the sidewall. The tamper-indicating band further includes a first hinge connection coupling the first portion to the second end of the sidewall and a second hinge connection coupling the second portion to the second end of the sidewall. The tamper-indicating band further includes a first gap defined between the clockwise facing surface of the first portion and the counterclockwise facing surface of the second portion and a second gap defined between the clockwise facing surface of the second portion and the counterclockwise facing surface of the first portion. The tamper-indicating band further includes a first frangible connection connecting the clockwise facing surface of the first portion to the counterclockwise facing surface of the second portion. The tamper-indicating band further includes a second frangible connection connecting the counterclockwise facing surface of the first portion to the clockwise facing surface of the second portion.

Another embodiment of the invention relates to a cap and dispenser assembly. The dispenser includes a tube defining a longitudinal axis having an exterior surface and a central channel extending between a first opening and a second opening. The dispenser further includes a top sealing surface defining a first end of the plastic tube. The dispenser further includes a thread extending radially outward from the exterior surface of the tube. The dispenser further includes an annular rim extending radially outward from the exterior surface of the tube below the thread. The dispenser further includes a first tab and a second tab extending radially outward from the exterior surface of the tube located above the annular rim and below the thread. The cap includes a sidewall centered around the longitudinal axis having an internal surface, a first end, and a second end. The cap further includes an outer shell surrounding the sidewall and a support structure coupling the outer shell to the sidewall such that rotation of the outer shell imparts rotation to the sidewall. The cap further includes a thread on the internal surface of the sidewall configured to engage with the thread on the exterior surface of the tube. The cap further includes a tamper band extending from the second end of the sidewall. The tamper band includes a first gap and a second gap defined in the tamper band. The tamper band further includes a first frangible connection and a second frangible connection between the tamper band and the second end of the sidewall. The first frangible connection is located above the first gap and the second frangible connection is located above the second gap. The tamper band extends around the dispenser such that the first tab of the dispenser extends at least a portion of the distance through the first gap and the second tab of the dispenser extends at least a portion of the distance through the second gap. Upon rotation of the cap relative to the dispenser, surfaces of the tamper band defining the first gap and the second gap engage respectively with the first tab and the second tab of the dispenser, causing the first and second frangible connections to break.

Alternative exemplary embodiments relate to other features and combinations of features as may be generally recited in the claims.

BRIEF DESCRIPTION OF THE DRAWINGS

This application will be more fully understood from the following detailed description, taken in conjunction with the accompanying figures, wherein like reference numbers refer to like elements in which.

DETAILED DESCRIPTION

Figure 1:
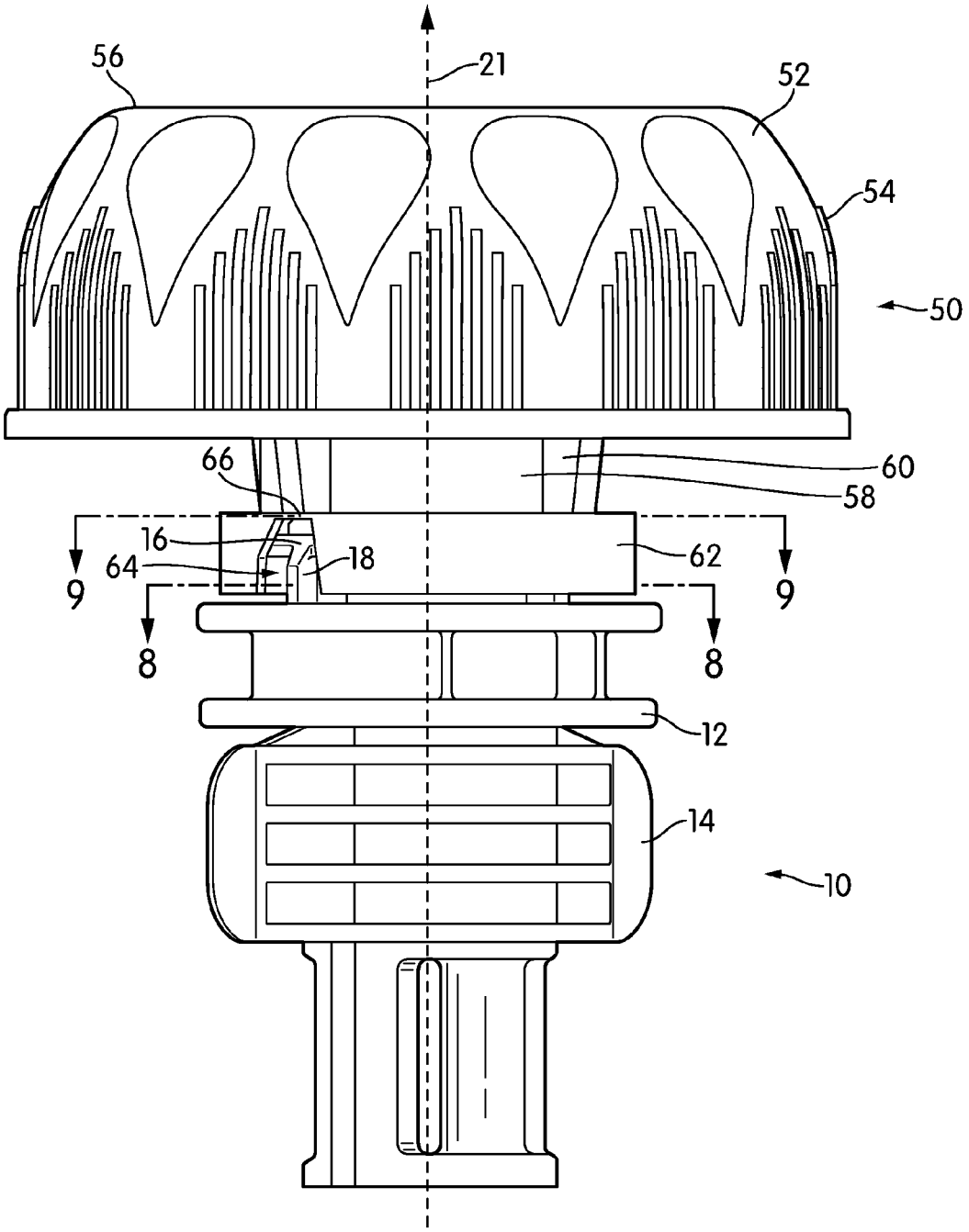
FIG. 1 is a front view of a closure attached to a spout according to an exemplary embodiment.

Referring generally to the figures, various embodiments of a closure and related spout are described. The closure has an inner wall enclosed by an end wall with an internal thread on the inner surface of the inner wall. The closure may include a sealing rim that extends down from the inner surface of the end wall. The inner wall is radially surrounded by an outer sidewall, with a passage between the inner wall and the outer sidewall that allows airflow through the closure. The embodiments of the closure include a tamper indicating band, also referred to as a tamper band or safety band. The tamper band is configured to provide a visual indication to the end user that the closure has not been opened since being sealed by the manufacturer.

The tamper band, which in one embodiment is a ring or loop of material located below the end of the inner wall, is attached to the inner wall of the closure with hinge connectors and frangible connectors. The tamper band includes an internal surface having an internal rim or rib that interacts with the dispenser assembly to permanently deform the tamper band upon removal of the closure by a user. The tamper band also includes gaps to interact with a dispenser assembly. Specifically, upon rotation, tabs on the dispenser assembly engage within the gaps of the tamper band, and further rotation of the closure causes the frangible connectors to break. In addition, the same rotating action of the closure causes an internal rim of the tamper band to engage a surface on the spout pushing the now broken tamper band outward. Through the combination of breaking of the frangible connectors and the action of the hinge connectors, the tamper band is broken and displaced, providing the visual indication to a user that the closure is opened while at the same time keeping the broken tamper band secured to the closure.

Compared to at least some conventional tamper bands, the tamper bands discussed herein are configured to provide increased visibility after the closure is opened. Specifically, as discussed in more detail below, the tamper band not only includes breaks points of connection with the main portion of the closure, but also includes hinge connections which allow the tamper band to rotate outward, increasing the visibility of the broken tamper band.

The rotation occurs in two steps and in two directions. In the first step, the initial twist by the user causes the first connection point between a portion of the tamper band and the main portion of the closure to break; the end of the portion of the tamper band connected to the first connection point swings radially outward as it comes into contact with a tab on the dispenser assembly during the counterclockwise rotation of the closure by the user. In the second step, the subsequent lift of the closure by the user breaks the second connection point between a portion of the tamper band and the main portion of the closure; the entire tamper band, now in separated portions, is forced outwards and upwards as it is pulled over the alignment rim on the dispenser assembly. This rotation of the separated portions of the tamper band creates a highly visible signal to the user that the closure has been tampered with prior to opening by the end user.

In addition, the closure and the tamper band discussed herein may be particularly suitable for containers, for example food or drink containers, intended for use by children. For example, because the tamper band remains attached to the closure after the container is opened, the likelihood that the tamper band is accidentally swallowed by a user may be reduced. For example, because the tamper band is removed along with the removal of the closure, it does not remain near the opening of the container where a user may place their mouth. In addition, in contrast to many single walled closures, the closure embodiments discussed herein include inner and outer walls separated by a space that allows passage of air through the closure. This configuration may allow a user to breath and seek medical attention if the closure becomes lodged in the airway of a user.

Figure 4:
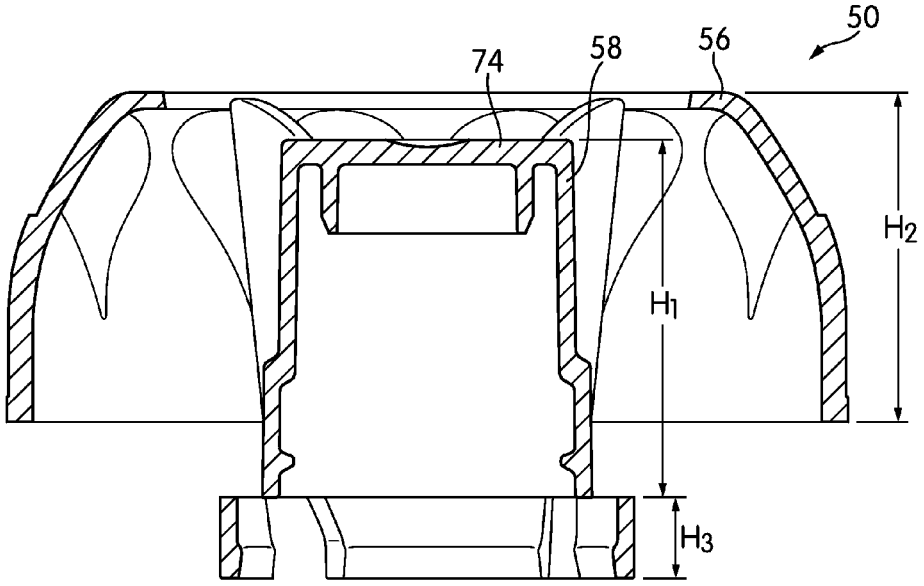
FIG. 4 is a cross-sectional view of the closure of FIG. 1 taken along line 4-4 in FIG. 3 according to an exemplary embodiment.

Referring to FIG. 1, a spout 10 is shown with a closure 50 according to an exemplary embodiment. The closure 50 has an outer sidewall 56 with an exterior surface 52, shown in this exemplary embodiment with a textured design 54 molded into the exterior surface. The textured design 54 facilitates gripping by a user. The outer sidewall 56 is attached to an inner wall 58 by a support structure, shown as vertical stabilizers 60. Although the embodiment shown has four vertical stabilizers (all four stabilizers 60 are shown in FIG. 4), closure 50 may include a different number of vertical stabilizers 60 as may be appropriate based on the material of the closure, the dimensions of the closure, and the intended use of the container.

Below the inner wall 58, the closure 50 has a tamper band or tamper-indicating band, shown as safety band 62, that extends around the dispenser assembly, shown as spout 10. The safety band 62 of the closure 50 includes a gap 64. Above the gap 64 in the safety band 62, the frangible connection, shown as bridge of material 66 over the gap 64 in the safety band 62, is shown unstretched and unbroken, signifying to the user that the closure 50 has not previously been removed from spout 10. In some embodiments, the length of the bridge of material 66 as it extends around the circumference of the safety band 62 measures between 0.015 and 0.030 inches. The frangible connection, shown as the band of material 66 over the gap 64 in the safety band 62 has a radial width or a radial dimension that is measured along a radius extending from the central axis. Similarly, the safety band 62 has a radial width or radial dimension that can be measured from an inner edge to an outer edge of the safety band 62 along a radius extending from the central axis.

As shown in FIG. 1, the spout 10 extends in the vertical direction along a central, longitudinal axis, shown as axis 21. The bottom portion of the spout 10 includes a pouch flange 12 and a pouch support structure 14; these structures provide an area for spout 10 to be coupled to a container, such as pouch container 100, shown in FIG. 13. Located above pouch flange 12 and pouch support structure 14, the spout 10 includes an annular rim 16 and a tab 18. The tab 18 of the spout 10 engages with the gap 64 of the safety band 62 of the closure 50. FIG. 1 shows the safety band 62 of the closure 50 before the closure 50 has been rotated by a user. In this closed configuration of the safety band 62, the tab 18 protrudes into the gap 64 of the safety band 62. As shown in FIG. 1, the gap 64 is sized larger than the tab 18. This size differential allows for small movements of the closure 50 in relation to the spout 10 during packing, storing, and shipping without stretching or breaking of the bridge of material 66 over the gap 64 in the safety band 62. In some embodiments of the spout 10 and closure 50, the tab 18 may protrude only a portion of the distance into gap 64, and in other embodiments, tab 18 may protrude all the way through the gap 64.

Figure 2:
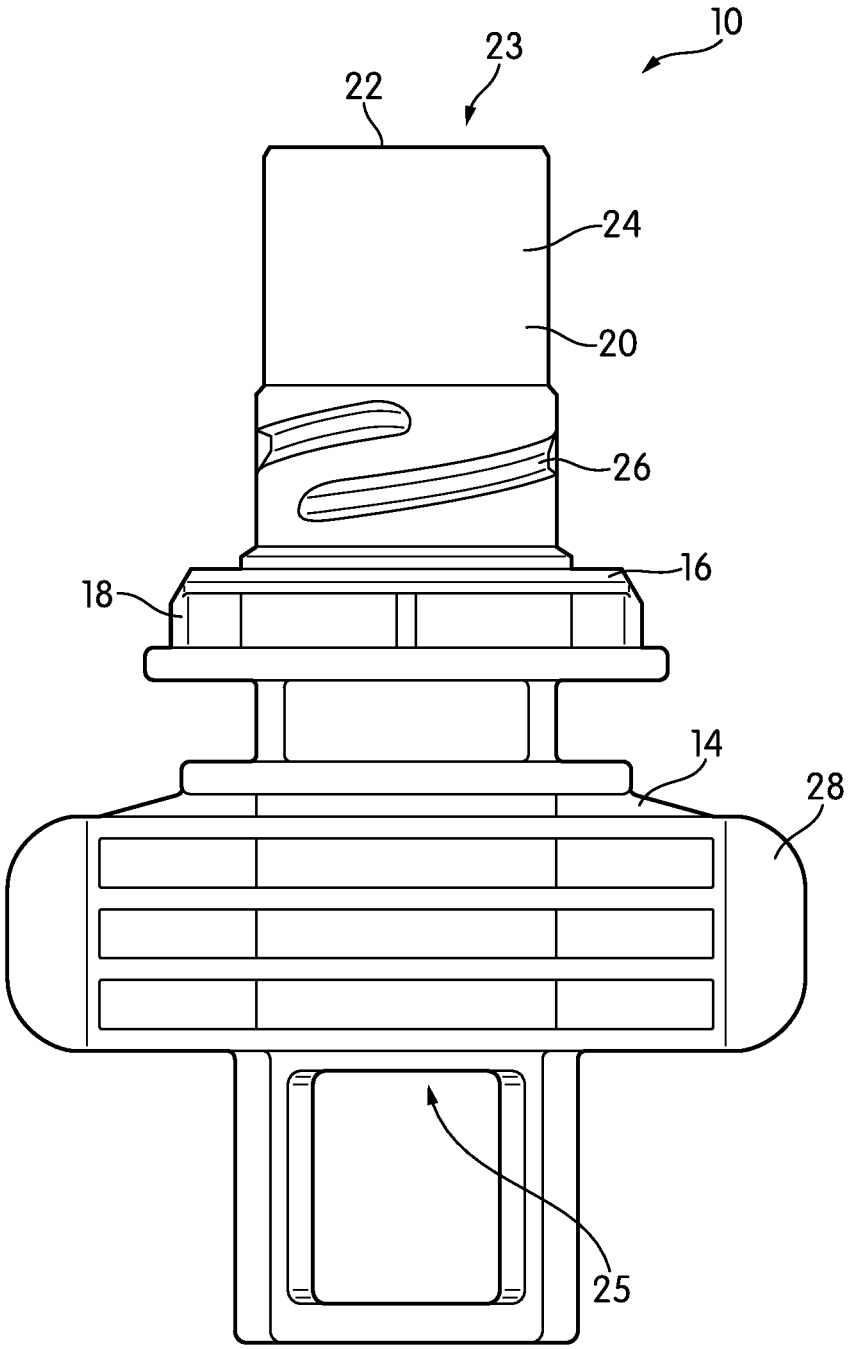
FIG. 2 is a front view of the spout of FIG. 1 according to an exemplary embodiment.

Referring to FIG. 2, the upper portion of spout 10 that is located within the closure 50 in FIG. 1 is shown in an exemplary embodiment. As shown, the spout 10 includes a hollow tube, shown as tube 20 that extends in the axial direction along the full length of the spout 10. The extreme end of the tube 20 is a top sealing surface 22 that engages with the closure 50. Spout 10 includes a first opening 23 at the upper end of spout 10 and a second opening 25 located at the lower end of spout 10. In general, a channel or passage is defined within tube 20 that provides a passageway for material within a container to be dispensed through spout 10. For example, in use, the upper portion of spout 10 may be inserted into the mouth of a user allowing the user to access the contents 98 of the container 100 (shown in FIG. 13).

Figure 13:
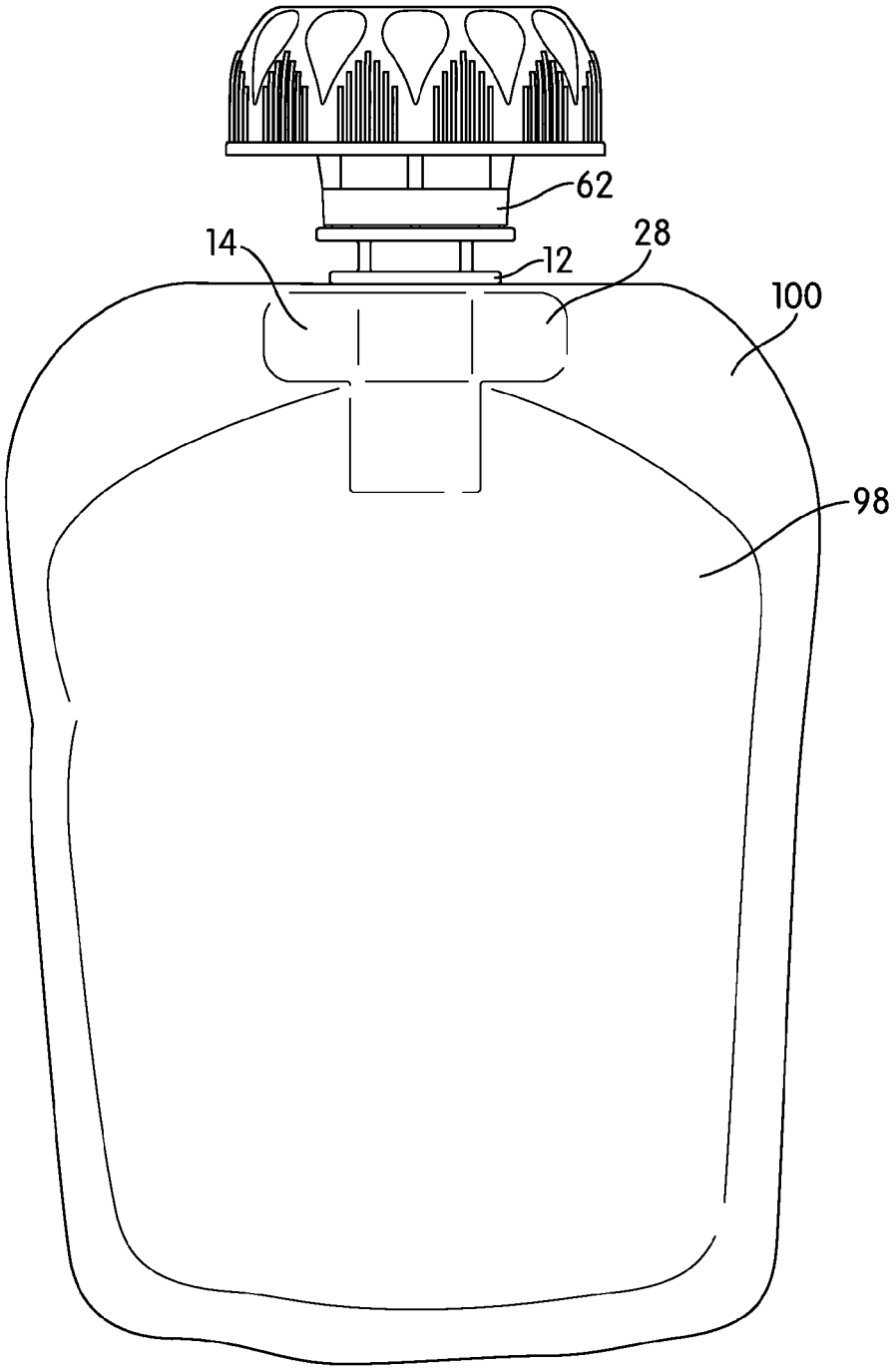
FIG. 13 is a side view of the closure and spout of FIG. 1 assembled with a pouch container according to an exemplary embodiment.

As shown in FIG. 2, additional features of the tube 20 are on the exterior surface 24 of the tube 20. At a distance below the top sealing surface 22 of the tube 20, there is at least one exterior thread 26 that engages with the closure 50. Below the exterior thread 26, the spout includes the annular rim 16 that extends radially out from the exterior surface 24 of the tube 20. The annular rim 16 engages with the safety band 62 of the closure 50. Below the annular rim 16, the tube 20 includes two tabs 18. In this embodiment of the spout 10, the pouch support structure 14 has two wings 28 that extend out on diametrically opposite sides of the exterior surface 24 of the tube 20. In this embodiment, these wings 28 are the radially outermost feature of the spout 10. In this embodiment of the spout 10, the tabs 18 are positioned over and aligned with the wings 28 so that the user is able to clearly view the safety band 62 when looking at the front of the container 100, as is shown in FIG. 13. In other embodiments, the tabs 18 are not positioned over the wings 28 of the pouch support structure 14. In other embodiments, the pouch support structure 14 may include other structures such as additional flanges, rings, etc., instead of wings 28 that allow for coupling to and support of the container.

Figure 3:
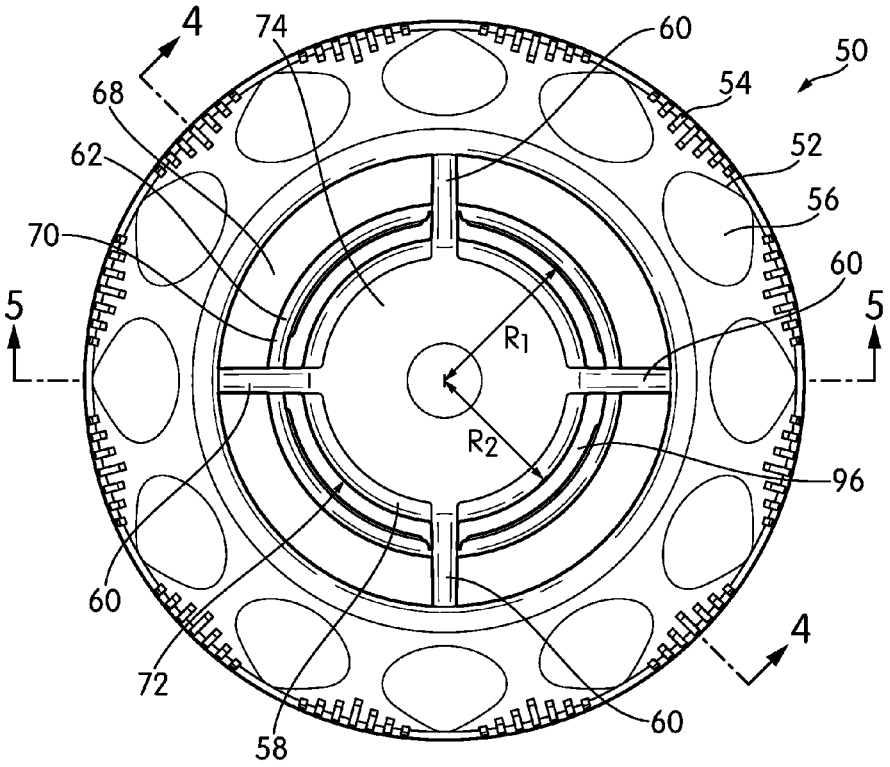
FIG. 3 is a top view of the closure of FIG. 1 according to an exemplary embodiment.

Referring to FIG. 3, a top view of the closure 50 is shown. As previously noted, the outer sidewall 56 has a textured design 54 extending around the perimeter of the closure 50. In this embodiment, the pattern is molded into the plastic outer sidewall 56 of the closure 50. In other embodiments, the pattern may be etched onto the exterior surface 52, printed onto the exterior surface 52, or adhered to the exterior surface 52. The pattern of the textured design 54 may vary in size, complexity, symmetry, or distribution. The closure 50 may not include a textured design 54 in an alternate embodiment.

FIG. 3 shows the end wall 74 of the closure 50. The end wall 74 encloses the inner wall 58 of the closure 50, sealing in the contents 98 of the container 100. FIG. 3 shows a channel 68 running through the closure 50 between the outer sidewall 56 and the inner wall 58. The channel 68 allows air to pass through the closure 50 as a safety measure to allow for one to breathe if the closure 50 is accidentally swallowed. The channel 68 prevents the complete obstruction of the airway by the closure 50 despite the presence of the end wall 74.

FIG. 3 also displays safety band 62. The upper surface 70 of the safety band 62 is visible through the channel 68 because the inner radius R1 of the safety band 62 is greater than the outer radius R2 of the inner wall 58. The inner wall 58 of the closure 50 has an exterior surface 72. The outer radius R2 of the inner wall 58 is measured from the central axis to the exterior surface 72 of the inner wall 58. The relationship between the inner radius R1 of the safety band 62 and the outer radius R2 of the inner wall 58 allows for the movement of the safety band 62 upon opening of the closure 50 by the user. Without space 96 between the safety band 62 and the exterior surface 72 of the inner wall 58, mechanical forces may limit the degree of movement of safety band 62 on opening of the container 100 which in turn may limit the visibility of the tamper indicating function provided by safety band 62. In one embodiment of closure 50, the radially exterior surface of the safety band 62 is a cylindrical surface.

When the container 100 is opened, not only are the bands of material 66 above the gaps 64 in the safety band 62 stretched and broken, but the safety band 62 itself is displaced radially outward by the removal of the closure 50. If the closure 50 is placed back on the container 100, the safety band 62 remains in the displaced position relative to its original position, having been pushed radially outwards away from the central axis and axially upwards by the annular rim 16. The displacement of the safety band 62 is shown in greater detail in FIG. 11 and FIG. 12.

Referring to FIG. 4, an exemplary embodiment of a cross-sectional view of the inside of the closure 50 is shown. This cross-sectional view displays the inner wall 58 and the outer sidewall 56. The inner wall 58 has a height, shown as H1. The outer sidewall 56 has a height, shown as H2. The safety band 62 has a height, shown as H3. In this embodiment, the end wall 74 and the upper end of the inner wall 58 are longitudinally below the upper end of the outer sidewall 56. Thus, in the embodiment shown, H2 is less than H1 and H3 is less than both H1 and H2.

Figure 5:
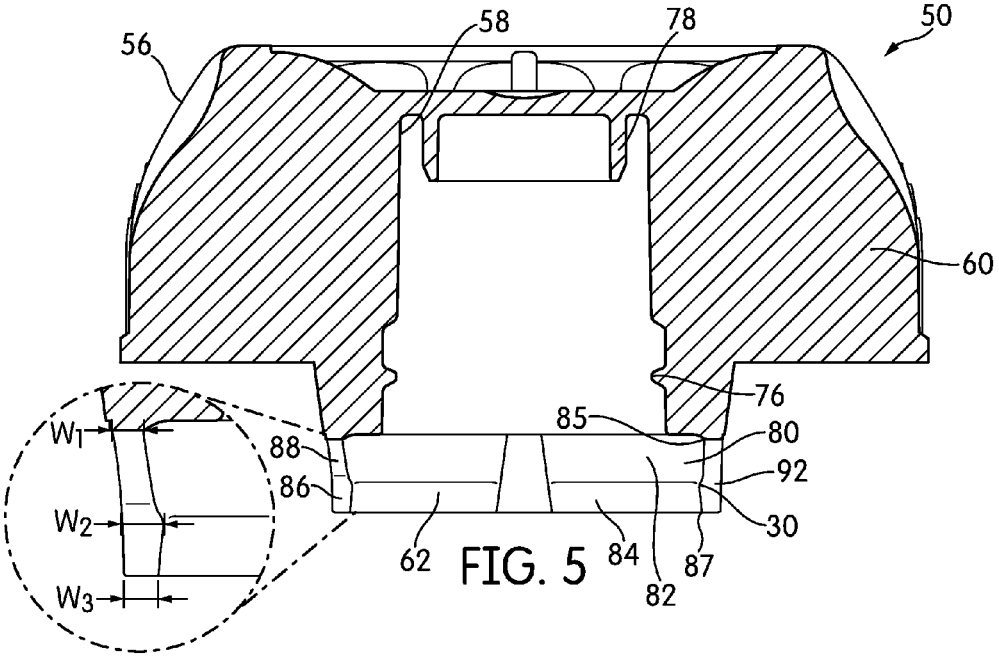
FIG. 5 is a cross-sectional view of the closure of FIG. 1 taken along line 5-5 in FIG. 3 according to an exemplary embodiment.

Referring to FIG. 5, an exemplary embodiment of a cross-sectional view of the inside of the closure 50 is shown. This cross-sectional view displays the vertical stabilizers 60 that connect the inner wall 58 and the outer sidewall 56. In this embodiment, the vertical stabilizers 60 are integrally formed with the outer sidewall 56 and the inner wall 58. In alternate embodiments, the vertical stabilizers 60 are formed independently of the outer sidewall 56 and the inner wall 58 and then attached (e.g., via welding) after formation. Inner wall 58 includes an interior thread 76 molded into the inner wall 58. The interior thread 76 of the inner wall 58 engages with the exterior thread 26 of the spout 10 to allow for sealing of the container 100 by rotation of the closure 50 on the spout 10. Sealing of the container 100 is accomplished by the interaction of the top sealing surface 22 of the spout 10 with the sealing rim 78 of the closure 50. The sealing rim 78 of the closure 50 is an annular rim that extends downward from the end wall 74 into the interior area formed by the inner wall 58.

The top sealing surface 22 fits into the area between the sealing rim 78 and the inner wall 58 to seal in the contents 98 of the container 100.

FIG. 5 also shows the cross-sectional shape and structure of the safety band 62. The safety band 62 has an internal surface 80 that extends around a majority of the circumference defined by the safety band 62. This internal surface 80 includes two portions, an upper portion 82 of the internal surface 80 of the safety band 62 and a lower portion 84 of the internal surface 80 of the safety band 62. The upper portion 82 extends radially inward and downward away from an upper edge 85 of inner surface 80 and the lower portion 84 of the internal surface 80 extends radially inward and upward from a lower edge 87 of inner surface 80 meet at a peak 30. In this arrangement, inner surface 80 forms a radially extending rib that cooperates with related structure on spout 10 to provide the tamper-indicating functionality discussed herein.

When assembled with spout 10, the upper portion 82 of the internal surface 80 of the safety band 62 is positioned against the alignment rim 16 of the spout 10 when the closure 50 is assembled onto the spout 10. When the closure 50 is removed with an upwards twisting motion by the end user, the position of the lower portion 84 of the internal surface 80 of the safety band 62 as radially inside the upper portion 82 means that the entire safety band 62 is forced outwards against the alignment rim 16. When the lower portion 84 is pushed against the alignment rim 16, the safety band 62 hinges outwards and permanently deforms, signaling to the user that the closure 50 has been opened after manufacture.

The safety band 62 as shown in FIG. 5 includes three widths. W1 is the width of the safety band 62 at the top of the safety band 62 adjacent to the vertical stabilizers 60. W2 is the maximum width of the safety band 62, and is positioned in the longitudinal midsection of the safety band 62. W3 is the width of the safety band 62 at the bottom of the safety band 62, at the lowermost edge of the closure 50. In the embodiment shown, W2 is greater than W1 and W3.

When assembled, the slope of the internal surface 80 from W1 to W2 rests against the annular rim 16 of the spout 10. When the closure 50 is pulled upwards by a user, the resistance from the annular rim 16 forces the displacement of the safety band 62 radially outwards. W3 is smaller than W2 to allow for the sliding of the safety band 62 over the alignment rim 16 of the spout 10 during initial assembly. When the closure 50 is initially placed onto the spout 10, the angled surface from the lower most edge of the closure 50 up to the longitudinal point at which the maximum width W2 occurs allows for placement of the closure 50 without any stretching or breaking of the bridge of material 66 over the gap 64 or any other damage to the safety band 62. In one embodiment, the safety band 62 snaps into place over the alignment rim 16 during assembly.

FIG. 5 also displays the differences between the two lateral surfaces that define the gap 64 in the safety band 62. The embodiment of safety band 62 shown has two gaps 64, and the cross-sectional view intersects the gaps so that the left side of FIG. 5 displays the counterclockwise facing surface of the gap 64 and the right side of FIG. 5 displays the clockwise facing surface of the opposing gap 64.

Figure 7:
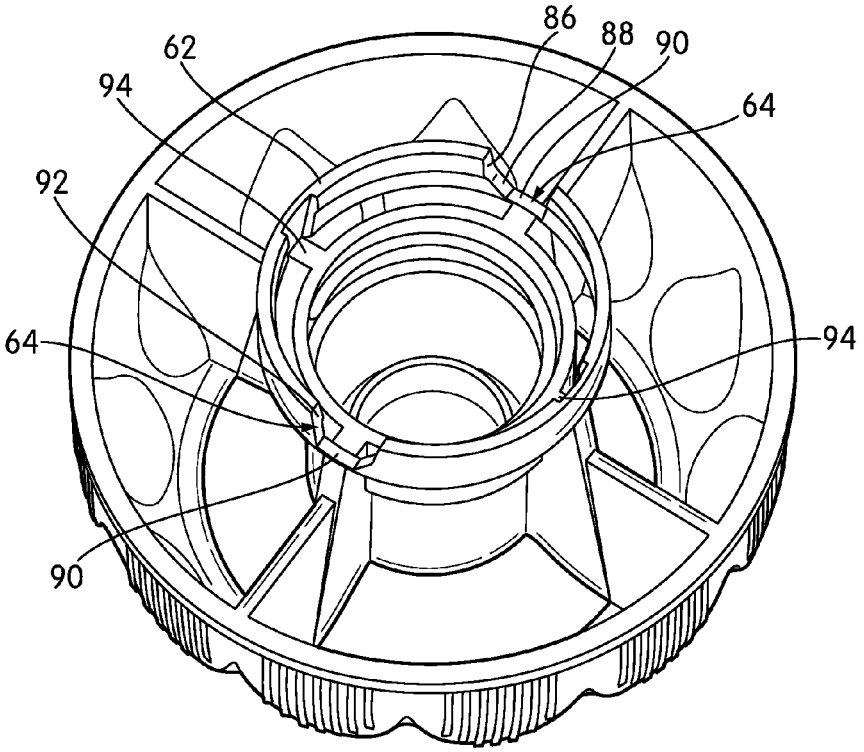
FIG. 7 is a bottom perspective view of the closure of FIG. 1 according to an exemplary embodiment.
Figure 8:
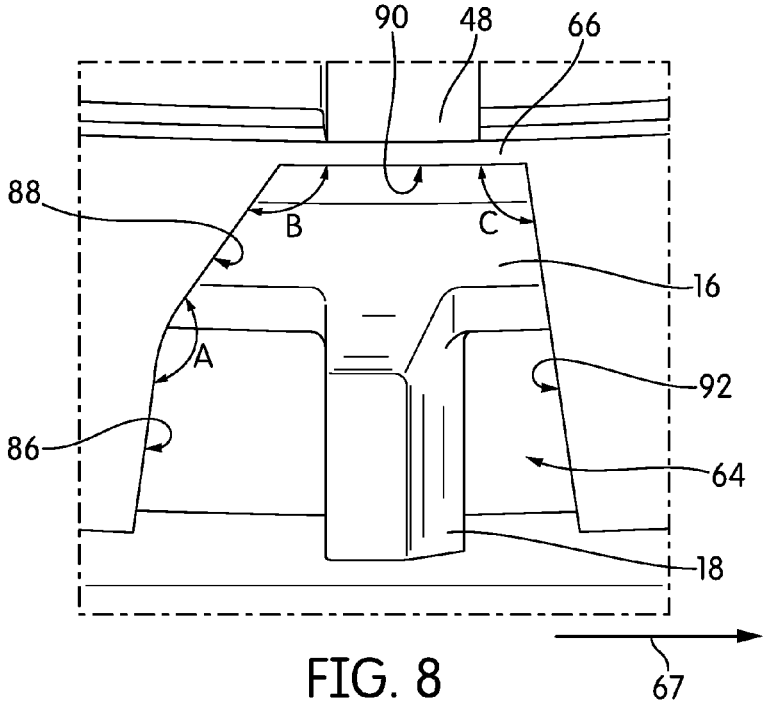
FIG. 8 is a detailed view of a portion of the closure and spout of FIG. 1 according to an exemplary embodiment.

Referring to FIGS. 5 and 8, safety band 62 includes two sets of four surfaces that extend between the radially inner surface and the radially outer surface of safety band 62 that each define a gap 64. The first inside surface 86 is the lower surface on the left side of the gap 64. The second inside surface 88 is the upper surface shown on the left side of the gap 64 in FIG. 5. The third inside surface 90 cannot be seen in FIG. 5 but can be seen in FIG. 7 and extends in the circumferential direction between the second inside surface 88 and the fourth inside surface 92. The third inside surface 90 is the bottom surface of the bridge of material 66 over the gap 64 in the safety band 62. In one embodiment of the closure 50, the third inside surface 90 is substantially parallel to the plane defined by the bottom edge of the safety band 62; i.e., the third inside surface is within +/−10 degrees of the plane defined by the bottom edge of the safety band 62. The fourth inside surface 92 of the gap 64 in the safety band 62 can be seen on the right side of the cross-sectional view of FIG. 5. In this embodiment, the longitudinal distance (or height) covered by the fourth inside surface 92 is the same as the longitudinal distance (or height) covered by the first inside surface 86 and the second inside surface 88. In various embodiments, because of the angled position (shown in FIG. 8) of second inside surface 88, the length of inside surface 88 is greater than if the angle of inside surface 88 matched the angle of inside surface 92. In this arrangement, the length of inside surface 88 may act as a lever arm facilitating breakage of bridge of material 66 during opening.

Referring again to FIG. 6 and FIG. 8, the four surfaces that define the gap 64 of the safety band 62 of the closure 50 meet at their edges. Where the first inner surface 86 and the second inner surface 88 meet, a first corner with an angle A is formed. Where the second inner surface 88 and the third inner surface 90 meet, a second corner with an angle B is formed. Where the third inner surface 90 and the fourth inner surface 92 meet, a third corner with an angle C is formed. In one embodiment of the closure 50, angle A, angle B, and angle C are all greater than 90 degrees but less than 180 degrees. In one embodiment of the closure 50, angle A is greater than both angle B and angle C. In one embodiment of the closure 50, angle C is the smallest of the three angles. In one embodiment, at least one of angle A or angle B is greater than 135 degrees.

Figure 9:
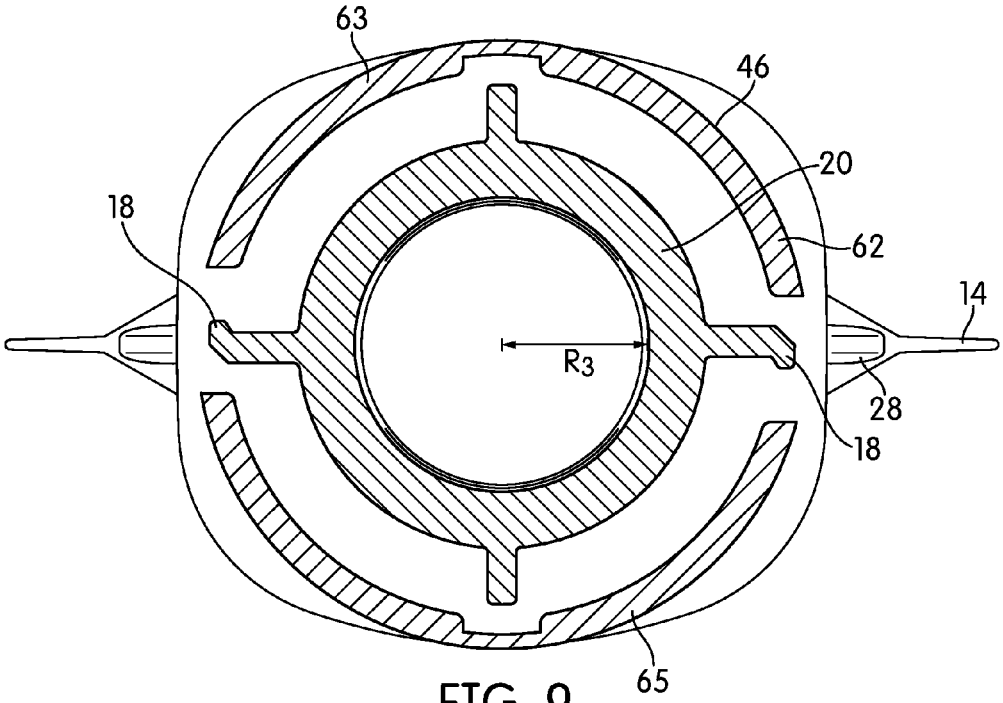
FIG. 9 is a cross-sectional view of the closure and spout of FIG. 1 taken along line 9-9 in FIG. 1 according to an exemplary embodiment.

Alternatively, referring to FIG. 9, the safety band 62 includes a first portion 63 and a second portion 65, extending between the clockwise and counterclockwise surfaces of the respective gaps 64. In one embodiment, first portion 63 and the second portion 65 of the safety band 62 each extend between 120 and 175 degrees around the circumference of inner wall 58. In other embodiments, first portion 63 and second portion 65 of the safety band 62 each extend at least 130 degrees and, more specifically, at least 150 degrees around the circumference of inner wall 58.

Figure 6:
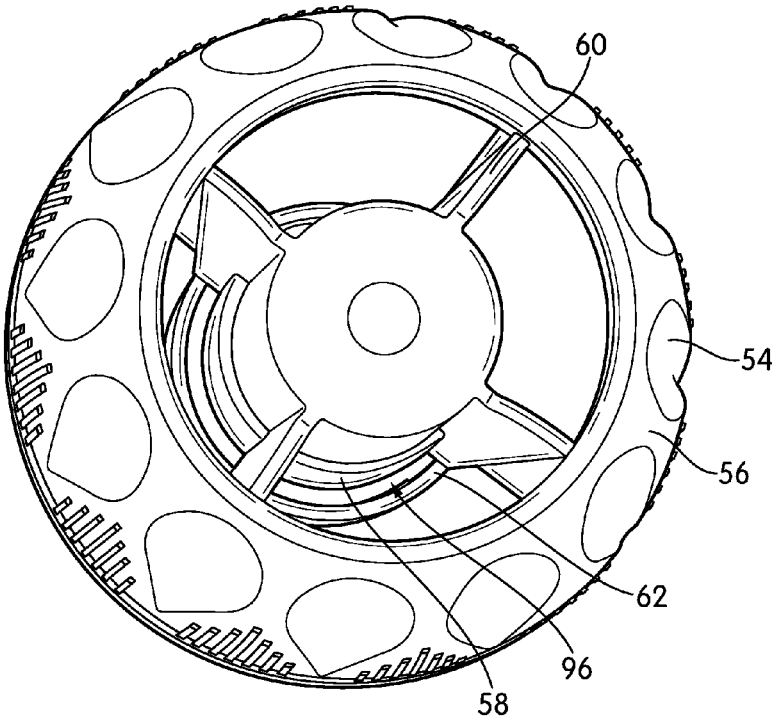
FIG. 6 is a top perspective view of the closure of FIG. 1 according to an exemplary embodiment.

Referring to FIG. 6, one embodiment of a top perspective view of the closure 50 is shown. In FIG. 6, raised surfaces and indentations on the exterior surface 52 of the outer sidewall 56 of the closure 50 are shown. This view emphasizes the space 96 between the safety band 62 and the inner wall 58. The space 96 is interrupted by the vertical stabilizers 60 that join the inner wall 58 to the outer sidewall 56, and that join the inner wall 58 to the safety band 62 at four points, three of which can be seen in FIG. 6. The orientation of the four vertical stabilizers 60 can also be seen in FIG. 6; in particular, this embodiment includes four evenly spaced vertical stabilizers 60 that extend outwards at 90° angles. Another embodiment may include two vertical stabilizers 60 at approximately 180 degrees from each other around the circumference safety band 62, i.e. within +/−10 degrees of 180 degrees. Other embodiments may include vertical stabilizers at different angles, or vertical stabilizers that do not join with the safety band 62.

In some embodiments, the vertical stabilizers 60, or any other features of the closure 50, may be described as diametrically opposite one another. This means that the features are approximately 180 degrees around a circumference from one another, within +/−10 degrees of 180 degrees. Additionally, if a range of error is not otherwise specified for a measurement described in degrees, the range of error should include all degrees within +/−10 of the measurement, inclusively.

Referring to FIG. 7, one embodiment of a bottom perspective view of the closure 50 is shown. The two hinge connectors 94 of the closure 50 can be seen in FIG. 7. In this embodiment, the hinge connectors 94 are diametrically opposite each other. This embodiment also has the hinge connectors 94 located equidistant around the circumference of the safety band 62 between the two gaps 64. In this embodiment, the first inside surface 86, the second inside surface 88, and the third inside surface 90 of one of the gaps 64 can be seen. FIG. 7 shows the second inside surface 88, the third inside surface 90, and the fourth inside surface 92 of the other gap. The third inside surfaces 90 of the gaps 64 extend in the circumferential direction between the second inside surfaces 88 and the fourth inside surfaces 92. The fourth inside surfaces 92 are planar surfaces that extend axially away from the third inside surfaces 90, but the first inside surfaces 86 and the second inside surfaces 88 form a convex angle with each other and extend both in the circumferential direction of the safety band 62 as well as extending axially.

Referring to FIG. 8, a detailed view of the tab 18 protruding into the gap 64 of the safety band 62 is shown. The frangible connector 48 extends axially upward from the bridge of material 66 above the gap 64 in the safety band 62. During opening, closure 50 is rotated in the counterclockwise direction indicated by arrow 67 in FIG. 8. In this embodiment, the frangible connector 48 is not as wide as the upper width of the gap 64, so that the bridge of material 66 is not reinforced and may stretch and break easily on opening of the closure 50 by a user. The left side of the bridge of material 66 will stretch and break as the second inside surface 88 and then the first inside surface 86 of the gap 64 hits the tab 18, forcing the tab 18 radially outwards. The right side of the bridge of material 66 will stretch and break as the annular rim 16 forces the safety band 62 outward as the closure 50 and safety band 62 are pulled up by the user. The combined distances of the first inside surface 86 and the second inside surface 88 increase the stress on the left side of the bridge of material 66; the greater the combined distances, the greater the stress on the left side of the bridge of material 66. FIG. 8 shows that the tab 18 is integrally formed with the alignment rim 16, giving it increased strength.

Referring to FIG. 9, a cross-sectional view of the inside of the closure 50 combined with the spout 10 is shown. The inner radius of the tube 20 is shown as R3. As previously noted, with closure 50 assembled, there is space or clearance between the surfaces that define gap 64 and tabs 18 such the safety band 62 are not accidentally damaged during packaging, shipping, and storage of the container 100. The tabs 18 of the spout 10 are aligned with the wings 28 of the pouch support structure 14.

The shape of the tabs 18 can be seen most clearly in FIG. 9. In this embodiment, the tabs 18 extend as far as the outer surface 46 of the safety band 62 but do not extend past the radially outer surface of safety band 62. To ensure that the tabs 18 do not break when the closure 50 is twisted by the user, the right side of the tabs 18 have a slanted angle. Thus, when the closure 50 is rotated counterclockwise to open the container 100, the side of the safety band 62 facing the tab 18 will hit the tab 18 and be pushed against the direction of rotation. This will force the end of the safety band 62 that is against the tab 18 radially outwards, breaking the left side of the bridge of material 66 over the gap 64 and freeing that end of the safety band 62 to be forced radially outwards.

Figure 10:
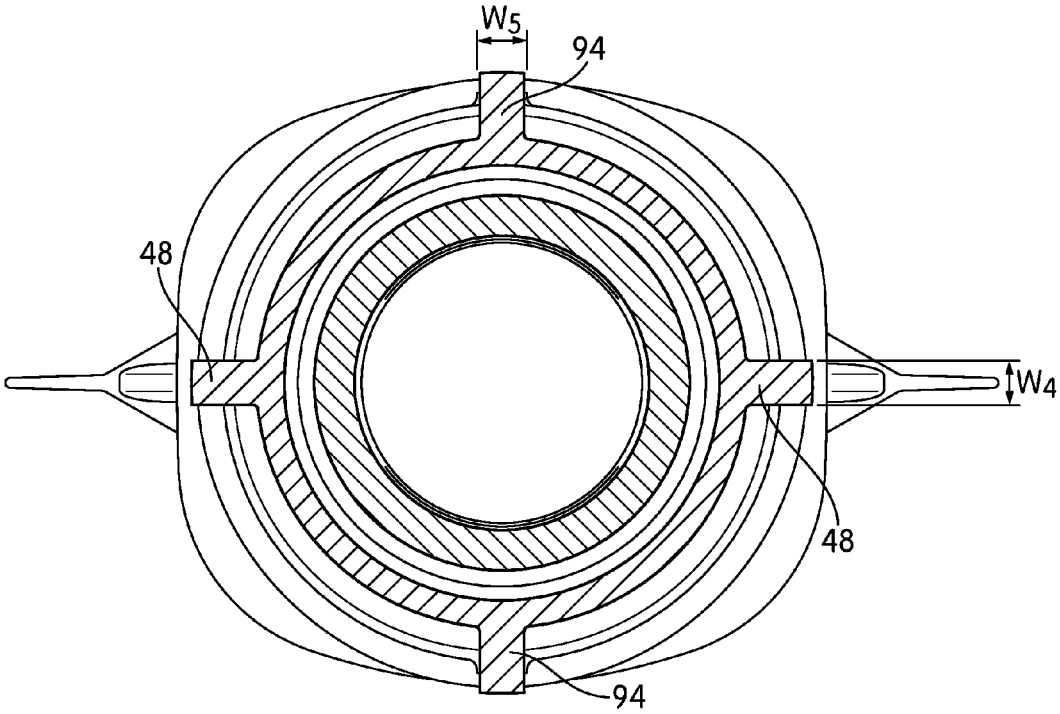
FIG. 10 is a cross-sectional view of the closure and spout of FIG. 1 taken along line 10-10 in FIG. 1 according to an exemplary embodiment.

Referring to FIG. 10, an exemplary embodiment of a cross-sectional view of the inside of the closure 50 combined with the spout 10 is shown. Here, the frangible connectors 48 and the hinge connectors 94 are shown. In this embodiment, the frangible connectors 48 are positioned over the wings 28 of the pouch support structure 14 of the spout 10 and the hinge connectors 94 are located equidistant around the circumference of the safety band 62 between the frangible connectors 48. The frangible connectors 48 have a width shown as W4. In one embodiment, the frangible connectors 48 extend around the circumference of the safety band 62 for less than 0.015 inches. In another embodiment the frangible connectors 48 extend around the circumference of the safety band 62 for less than 0.030 inches. The hinge connectors 94 have a width shown as W5. In one embodiment, W4 is equal to W5.

Figure 11:
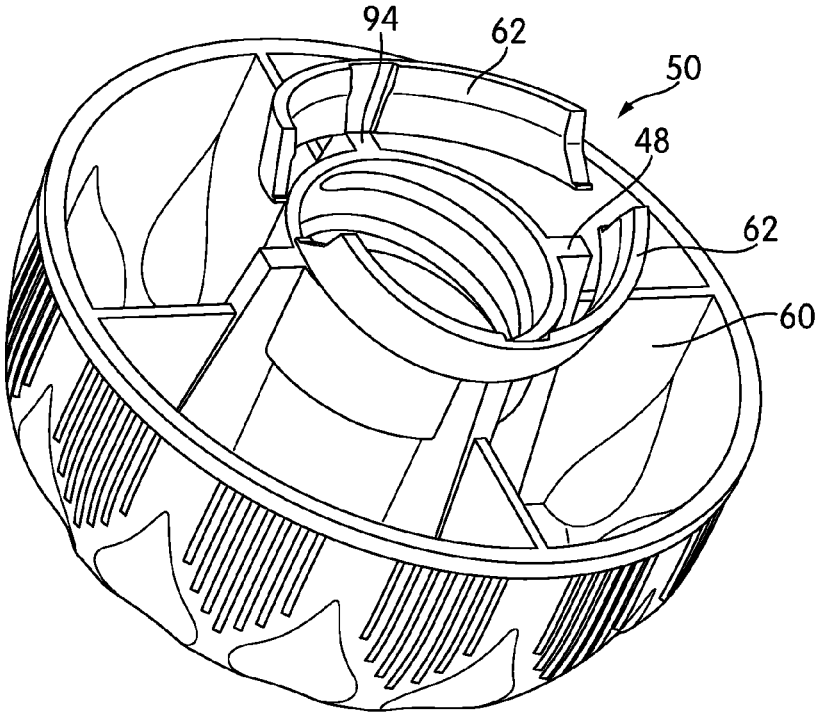
FIG. 11 is a bottom perspective view of the closure of FIG. 1 with the tamper band in an open configuration according to an exemplary embodiment.

Referring to FIG. 11, the closure 50 is shown after a user has opened the container 100 and removed the closure 50 from spout 10. The bridges of material 66 over the gaps 64 are broken, separating the safety band 62 into two halves. The two hinge connectors 94 are intact, while the halves of the safety band 62 have been rotated radially outward around the points of connection between the hinge connectors 94 and the safety band 62. The frangible connectors 48 are no longer connected with the safety band 62. The halves of the safety band 62 are rotated upwards and radially outward. The appearance of the safety band 62 is noticeably different and will alert a user to the previous opening of the container 100. In other embodiments, the number of gaps 64 may vary and the safety band 62 may be broken into thirds, quarters, or another number of equal parts.

Figure 12:
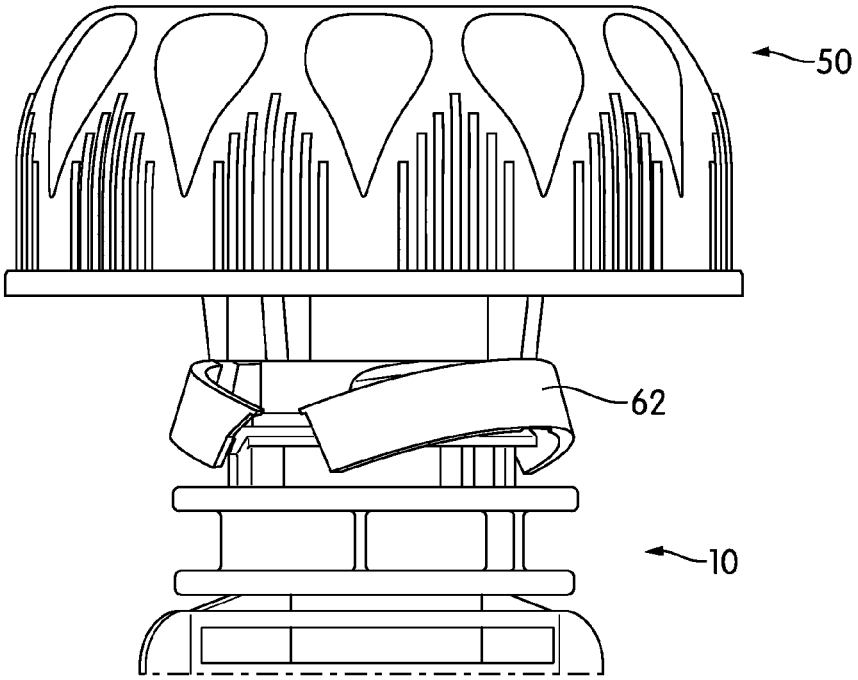
FIG. 12 is a front view of the closure and spout of FIG. 1 with the tamper band in an open configuration according to an exemplary embodiment.

Referring to FIG. 12, the closure 50 is shown after a user opened the container and replaced the opened closure 50 back onto the spout 10 of the container 100. Without an intact bridge of material 66, the halves of the safety band 62 angle axially downwards such that the free end of safety band 62 is axially below the position of the hinged connector 94. The lower edges of the central portion of safety band 62 adjacent to the hinge connectors 94 are pushed radially outwards and axially upwards. However, the safety band 62 is still securely connected to the remaining portions of the closure 50 via the connection of hinged connector 94.

Referring to FIG. 13, the spout 10 and closure 50 may be assembled with a pouch container 100. The pouch container 100 holds contents 98. The wings 28 of the pouch support structure 14 extend underneath the sides of the pouch container 100. The pouch container 100 is adhered or bonded to the wings 28 of the pouch support structure 14 and the pouch flange 12. This adhesion or bonding between the container 100 and structures of the spout 10 may involve an adhesive, a melted thermoplastic, heat welding, ultrasonic welding, or other means for sealing the structures together. The spout 10 may be assemble with the closure 50 before insertion into the container 100 that has been prefilled with contents 98, or the spout 10 may be inserted into an empty container 100 that is then filled with contents 98 through the spout 10, after which the closure 50 is added to the spout 10. In other embodiments, the container may be a bottle, flask, jug, bag, bag-in-a-box, etc. The container 100, closure 50, and spout 10 in FIG. 13 represent only an example of one embodiment, and are not limiting in terms of either absolute size or relative size of any of the components.

Figure 14:
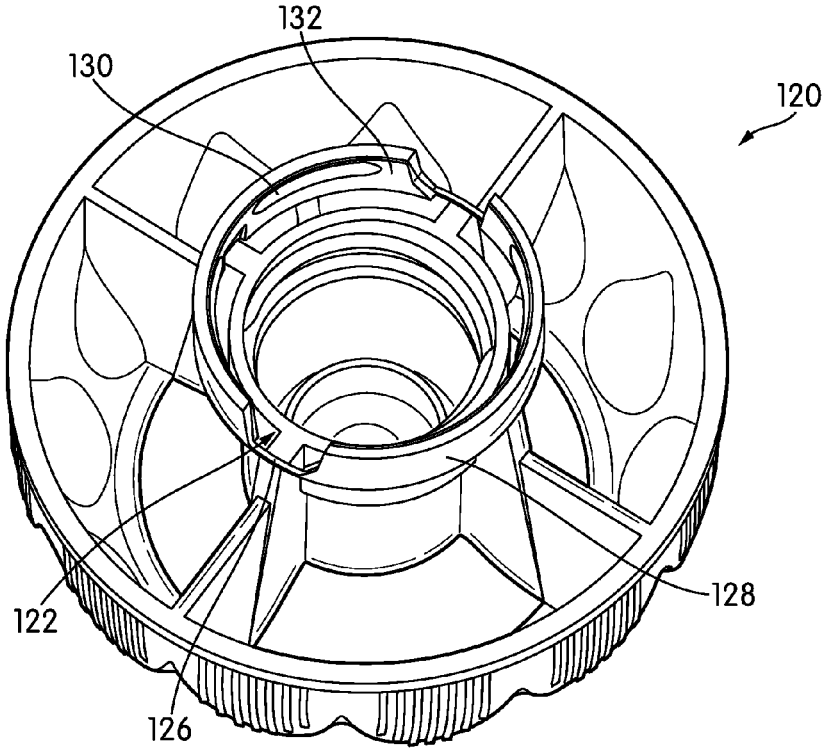
FIG. 14 is a bottom perspective view of a closure according to another embodiment.

Referring to FIG. 14, a closure 120 is shown according to an exemplary embodiment. Closure 120 is substantially the same as closure 50 except for the differences discussed herein. Closure 120 includes a safety band 128 and a bridge of material 126 over the first gap 122 of the closure 120 that extends for a shorter distance in the radial direction than the bridge of material 66 of the closure 50. That is to say, the bridge of material 126 in the closure 120 is thinner than the bridge of material 66 of the closure 50. The shorter radial distance of the bridge of material 126 may allow bridge of material 126 to break more easily than the bridge of material 66 of safety band 62 of the closure 50.

In addition, closure 120 includes an internal rim 130 of the safety band 128 extending from the radially inward facing surface of safety band 128. The internal rim 130 of the safety band 128 extends around a smaller portion of the circumference of the safety band 128 than the internal rim of the closure 50. As shown the internal rim 130 of the safety band 128 does not extend the entire circumferential distance from the clockwise facing surface to the counterclockwise facing surface of a portion of the safety band 128 of the closure 120. In the embodiment shown, the internal rim 130 of the safety band 128 is not continuous in the circumferential around the inner surface of safety band 128 and includes a gap or space in rim 130 shown at 132.

Figure 15:
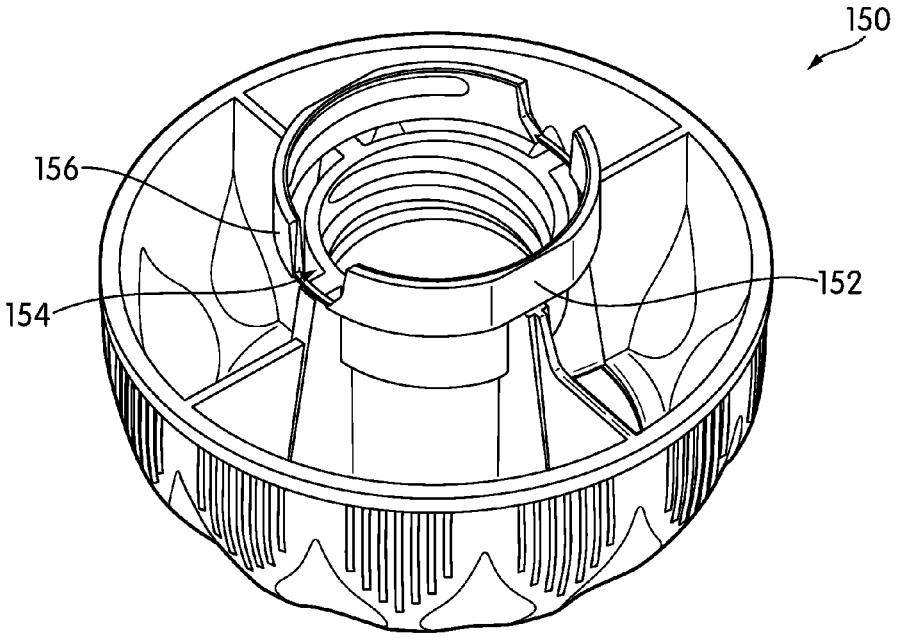
FIG. 15 is a bottom perspective view of a closure according to another embodiment.

Referring to FIG. 15, a closure 150 is shown according to an exemplary embodiment. Closure 150 is substantially the same as closure 50 except for the differences discussed herein. The exterior surface of the safety band 156 is cylindrical for the majority of the circumference of the safety band 156. However, the exterior surface of safety band 156 includes a substantially flat or planar section 152. In some embodiments, the combined circumferential length of the cylindrical portions of safety band 156 is between 240 degrees and 350 degrees of the circumference of the safety band 156 with the remaining circumferential length of safety band resulting from planar sections 152 and gaps 154. In some embodiments, the combined portions of the safety band 156 that are curved stretch around between 270 to 300 degrees of the circumference of the safety band 156.

In various embodiments, the closure 50 and/or spout 10 may be formed from a molded plastic material. In various embodiments, closure 50 and/or spout 10 may be polyethylene, polypropylene, polyethylene terephthalate, or any other suitable plastic material. In various embodiments, the closure 50 and/or spout 10 may be formed through any suitable molding method including, injection molding, compression molding, etc.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. Other substitutions, modifications, changes and omissions may also be made in the design, operating conditions and arrangement of the various exemplary embodiments without departing from the scope of the present invention.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above in the implementation of the teachings of the present disclosure.

What is claimed is:

1. A plastic closure for a container comprising:

a sidewall defining a longitudinal axis having a first end and a second end;

an end wall sealed to the first end of the sidewall;

a thread extending from an inner surface of the sidewall; and a tamper-indicating band positioned below the second end of the sidewall, the tamper indicating band comprising:

a first portion including a clockwise facing surface and a counterclockwise facing surface, wherein the first portion extends at least 130 degrees around the second end of the sidewall;

a first hinge connection coupling the first portion to the second end of the sidewall, wherein the first hinge connection is located equidistant from the clockwise facing surface and from the counterclockwise facing surface of the first portion of the tamper-indicating band;

a second portion including a clockwise facing surface and a counterclockwise facing surface, wherein the second portion extends at least 130 degrees around the second end of the sidewall;

a second hinge connection coupling the second portion to the second end of the sidewall, wherein the first hinge connection and the second hinge connection are located opposite each other around the circumference of the tamper-indicating band;

a first gap defined between the clockwise facing surface of the first portion and the counterclockwise facing surface of the second portion; and a second gap defined between the clockwise facing surface of the second portion and the counterclockwise facing surface of the first portion;

a first frangible connection connecting the clockwise facing surface of the first portion to the counterclockwise facing surface of the second portion; and a second frangible connection connecting the clockwise facing surface of the second portion to the counterclockwise facing surface of the first portion.

2. A plastic closure for a container comprising:

a sidewall defining a longitudinal axis having a first end and a second end;

an end wall sealed to the first end of the sidewall;

a thread extending from an inner surface of the sidewall; and a tamper-indicating band positioned below the second end of the sidewall, the tamper indicating band comprising:

a first portion including a clockwise facing surface and a counterclockwise facing surface, wherein the first portion extends at least 130 degrees around the second end of the sidewall;

a first hinge connection coupling the first portion to the second end of the sidewall;

a second portion including a clockwise facing surface and a counterclockwise facing surface, wherein the second portion extends at least 130 degrees around the second end of the sidewall;

a second hinge connection coupling the second portion to the second end of the sidewall;

a first gap defined between the clockwise facing surface of the first portion and the counterclockwise facing surface of the second portion; and a second gap defined between the clockwise facing surface of the second portion and the counterclockwise facing surface of the first portion;

a first frangible connection connecting the clockwise facing surface of the first portion to the counterclockwise facing surface of the second portion; and a second frangible connection connecting the clockwise facing surface of the second portion to the counterclockwise facing surface of the first portion; and the first hinge connection having a first connection width, the second hinge connection having a second connection width, the first frangible connection having a third connection width and the second frangible connection having a fourth connection width, wherein the first, second, third, and fourth connection widths are all equal.

3. The plastic closure of claim 2 wherein the radial dimensions of the clockwise facing surfaces of the first and second portions of the tamper-indicating band are greater than a radial dimension of the first and second frangible connections.

4. The plastic closure of claim 2 wherein the first portion extends at least 150 degrees around the second end of the sidewall, wherein the second portion extends at least 150 degrees around the second end of the sidewall.

5. A cap and dispenser assembly for a container comprising:

a dispenser comprising:

a tube defining a longitudinal axis having an exterior surface and a top sealing surface defining a first end of the tube, the tube having a central channel extending between a first opening and a second opening;

a thread extending radially outward from the exterior surface of the tube;

an annular rim extending radially outward from the exterior surface of the tube below the thread;

a first tab extending radially outward from the exterior surface of the tube located above the annular rim and below the thread; and a second tab extending radially outward from the exterior surface of the tube located above the annular rim and below the thread; and a cap comprising:

a sidewall having an internal surface and a first end and a second end, centered around the longitudinal axis;

an outer shell surrounding the sidewall;

a support structure coupling the outer shell to the sidewall such that rotation of the outer shell imparts rotation to the sidewall;

a thread on the internal surface of the sidewall configured to engage with the thread on the exterior surface of the tube; and a tamper band extending from the second end of the sidewall, the tamper band comprising:

a first gap defined in the tamper band;

a first frangible connection between the tamper band and the second end of the sidewall, the first frangible connection located above the first gap;

a second gap defined in the tamper band;

a second frangible connection between the tamper band and the second end of the sidewall, the second frangible connection located above the second gap;

wherein the tamper band extends around the dispenser such that the first tab of the dispenser extends at least a portion of the distance through the first gap and the second tab of the dispenser extends at least a portion of the distance through the second gap;

wherein upon rotation of the cap relative to the dispenser, tamper-band surfaces defining the first gap and the second gap engage the first tab and second tab, respectively, causing the first and second frangible connections to break.

6. The cap and dispenser assembly of claim 5 wherein the outer shell of the cap further includes an upper opening that has a first radius and the tamper band has a second radius, and the second radius is smaller than the first radius.

7. The cap and dispenser assembly of claim 5 wherein the tamper band has a longitudinal height and a radial width and the longitudinal height of the tamper band is greater than the radial width of the tamper band.

8. The cap and dispenser assembly of claim 5 wherein the dispenser further comprises a pouch support structure having an outer surface and further comprising a pouch coupled to the pouch support structure such that the first opening of the tube of the dispenser is located outside of the pouch and that the second opening of the tube of the dispenser is located within a contents cavity of the pouch.

9. The cap and dispenser assembly of claim 5 wherein the tamper band includes a first hinged connection and a second hinged connection both coupling the tamper band to the second end of the sidewall of the cap, wherein the first hinged connection is located equidistance from both the first gap and the second gap around a circumference of the tamper band, wherein the second hinged connection is located equidistance from both the first gap and the second gap around a circumference of the tamper band, wherein the first hinged connection and the second hinged connection are located on opposite halves of the tamper band.

10. A closure for a container comprising:

an inner wall having a first end, a second end, and an interior surface that defines a central axis;

a thread on the interior surface of the inner wall;

an end wall that encloses the first end of the inner wall;

an outer sidewall having a first end and second end, wherein the inner wall is located inside of and surrounded by the outer sidewall;

a channel located between the inner wall and the outer sidewall that allows air to pass through the closure;

a support structure coupling the inner wall to the outer sidewall;

a tamper band extending downward away from the second end of the inner wall, the tamper band comprising:

a radially outward facing surface;

a radially inward facing surface;

first and second frangible connectors coupling the tamper band to the second end of the inner wall;

first and second hinge connectors coupling the tamper band to the second end of the inner wall;

a first gap and a second gap extending between the radially outward facing surface and the radially inward facing surface, wherein the first hinge connector is located between the first and second gaps in the clockwise direction and the second hinge connector is located between the first and second gaps in the counterclockwise direction; and a rib extending radially inward from the radially inward facing surface and extending in the circumferential direction along the radially inward facing surface, wherein the rib includes an upper surface extending radially inward and away from an upper edge of the radially inward facing surface and a lower surface extending radially inward and away from a lower edge of the radially inward facing surface.

11. The closure of claim 10 wherein the outer sidewall further comprises an exterior surface, and wherein the exterior surface of the outer sidewall has a pattern molded into the exterior surface.

12. The closure of claim 10 further comprising a sealing rim extending from an inner surface the end wall.

13. The closure of claim 10 wherein the first gap and the second gap each are defined by a first inner surface, a second inner surface, a third inner surface, and a fourth inner surface, and wherein a corner between the second inner surface and the third inner surface forms an angle between 92° and 178°.

14. The closure of claim 10 wherein the first and second hinge connectors are each located equidistant between the first gap and the second.

15. The closure of claim 10 wherein an outer diameter of the tamper band is greater than an outer diameter of the second end of the inner wall and less than an outer diameter of the second end of the outer sidewall.

16. The closure of claim 10 wherein the inner wall further comprises an exterior surface and the outer sidewall further comprises an interior surface, and the support structure extends between an exterior surface of the inner wall and an interior surface of the outer sidewall.

17. The closure of claim 16 wherein the support structure includes a first wall and a second wall both extending from the exterior surface of the inner wall, wherein the first wall is spaced about 180 degrees from the second wall.

18. A plastic closure for a container comprising:

an inner wall defining a longitudinal axis having a first end and a second end;

an end wall sealed to the first end of the inner wall;

a thread extending from an inner surface of the inner wall;

an outer wall surrounding the inner wall;

a support structure coupling the outer wall to the inner wall such that rotation of the outer wall imparts rotation to the inner wall;

a channel located between the inner wall and the outer wall that extends in the direction of the longitudinal axis that allows air to pass through the closure and a tamper-indicating band positioned below the second end of the inner wall, the tamper indicating band comprising:

a first portion including a clockwise facing surface and a counterclockwise facing surface, wherein the first portion extends at least 130 degrees around the second end of the inner wall;

a first hinge connection coupling the first portion to the second end of the inner wall, wherein the first hinge connection is located equidistant from the clockwise facing surface and from the counterclockwise facing surface of the first portion of the tamper-indicating band;

a second portion including a clockwise facing surface and a counterclockwise facing surface, wherein the second portion extends at least 130 degrees around the second end of the inner wall;

a second hinge connection coupling the second portion to the second end of the inner wall, wherein the first hinge connection and the second hinge connection are located opposite each other around the circumference of the tamper-indicating band;

a first gap located between the clockwise facing surface of the first portion and the counterclockwise facing surface of the second portion;

a second gap located between the clockwise facing surface of the second portion and the counterclockwise facing surface of the first portion;

a first frangible connection located between the clockwise facing surface of the first portion and the counterclockwise facing surface of the second portion; and a second frangible connection located between the clockwise facing surface of the second portion and the counterclockwise facing surface of the first portion.

19. The plastic closure of claim 18 wherein the first portion extends at least 150 degrees around the second end of the inner wall, wherein the second portion extends at least 150 degrees around the second end of the inner wall.

20. The plastic closure of claim 19 wherein a lower surface of the tamper indicating band defines a lower most surface of the closure.

21. The plastic closure of claim 20 wherein an outer diameter of the tamper band is greater than an outer diameter of the second end of the inner wall and less than an outer diameter of the second end of the outer wall.

* * * * *